United States Patent [19]

Conway

[11] 4,144,829

[45] Mar. 20, 1979

[54] METHOD AND APPARATUS FOR VENTING HYDROCARBON GASES FROM THE CARGO COMPARTMENTS OF A TANKER VESSEL

[76] Inventor: Charles S. Conway, Featherbed La., New Vernon, N.J. 07976

[21] Appl. No.: 829,775

[22] Filed: Sep. 1, 1977

[51] Int. Cl.[2] ..... B63B 25/08

[52] U.S. Cl. ..... 114/74 R

[58] Field of Search ..... 114/74 R, 74 A, 256, 114/257, 16 E, 121, 125; 220/9 R, 9 A, 9 LG

[56] References Cited

U.S. PATENT DOCUMENTS

| | | | |
|---|---|---|---|
| 2,314,555 | 3/1943 | Preuss | 114/74 R |
| 3,844,239 | 10/1974 | McLaughlin | 114/74 R |
| 3,926,135 | 12/1975 | Degregorio | 114/74 R |

*Primary Examiner*—Trygve M. Blix
*Assistant Examiner*—D. W. Keen
*Attorney, Agent, or Firm*—Kenyon & Kenyon, Reilly, Carr & Chapin

[57] ABSTRACT

An improved method and apparatus for venting hydrocarbon gases from the cargo compartments of a tanker vessel for the transportation of oil in water, which tanker vessel includes a hull comprising a bottom and sides, a top deck, a plurality of watertight cargo compartments disposed in the hull between the top deck and the hull bottom for receiving the oil, and vent means coupled to each of the cargo compartments and communicative externally of the compartments for venting hydrocarbon gases to and from the cargo compartments and the atmosphere during loading, discharge and transfer of oil and ballast from the compartments. In an apparatus according to the invention, the improvement comprises valve means, coupled to and communicative with at least two of the cargo compartments and disposed at the top of the compartments, which interconnects the two cargo compartments for venting hydrocarbon gases from one of the two compartments to the other of the compartments after discharge of oil from the one of the compartments. In a method according to the invention, the valve means coupled to one of the cargo compartments from which oil is to be discharged is opened subsequent to discharging oil from the compartment so as to operatively interconnect the compartment with another, empty compartment in the tanker vessel. The vent means of both compartments are then closed so as to render the compartments non-communicative to the atmosphere. The emptied cargo compartment is then filled with a liquid so as to expel the hydrocarbon gases from the compartment and vent the gases to the other of the cargo compartments through the valve means.

10 Claims, 4 Drawing Figures

METHOD AND APPARATUS FOR VENTING HYDROCARBON GASES FROM THE CARGO COMPARTMENTS OF A TANKER VESSEL

BACKGROUND OF THE INVENTION

1. Field of the Invention

This invention relates generally to a tanker vessel for the transportation of oil in water, and in particular to an improved method and apparatus for venting hydrocarbon gases from empty cargo compartments of such a tanker vessel.

2. Description of the Prior Art

Tanker vessels for the transportation in bulk of liquid cargo such as oil are known in the art. See, for example, U.S. Pat. No. 2,918,032. Such tanker vessels generally comprise a plurality of liquid-tight transverse bulkheads and one or more liquid-tight longitudinal bulkheads which subdivide the tanker vessel into a plurality of liquid-tight cargo compartments for receiving the liquid cargo to be carried by the tanker vessel.

Presently, after a fully-loaded oil tanker discharges its cargo in port, the emptied tanks thereof are contaminated with hydrocarbon gases formed from the oil carried by the vessel. Before leaving port, at least some of these empty cargo tanks must be filled with ballast, which may be sea water, or liquid cargo transferred from another source or other cargo tanks in the vessel. While filling these contaminated empty tanks, the hydrocarbon gases contained therein are vented to the atmosphere. Such hydrocarbon gases contribute significantly to air pollution in coastal areas near ports where oil tankers are loaded and unloaded. In addition, such gases present a safety hazard to the crews of such vessels and to shore personnel during deck operations which are carried out on such vessels during filling of empty cargo tanks contaminated by such hydrocarbon gases.

SUMMARY OF THE INVENTION

It is therefore an object of the present invention to provide an improved method an apparatus for venting hydrocarbon gases from the cargo compartments of a tanker vessel for the transportation of oil in water which will reduce the pollution of air in coastal areas caused by the venting of such hydrocarbon gases to the atmosphere and will improve safety conditions aboard such tanker vessels during the filling of cargo compartments containing such hydrocarbon gases.

The foregoing and other objects of the invention are achieved in a tanker vessel for the transportation of oil in water, which vessel includes a hull comprising a bottom and sides, a top deck, a plurality of watertight cargo compartments disposed within the hull between the top deck and the hull bottom for receiving the oil, and vent means coupled to each of the cargo compartments and communicative externally of the compartments for venting hydrocarbon gases from the cargo compartments to the atmosphere after discharge of oil from the compartments. The improvement of the invention comprises valve means, coupled to and communicative with at least two of the cargo compartments and disposed at the top of the compartments, which valve means interconnects the two compartments for venting, hydrocarbon gases from one of the two cargo compartments to the other of the cargo compartments after discharge of oil from the one of the compartments.

In a preferred embodiment of the apparatus of the invention, the valve means includes pipe means coupled to the two cargo compartments and the valve means is coupled to the pipe means for venting the hydrocarbon gases from the one of the cargo compartments to the other of the compartments through the pipe means.

In other preferred embodiment of the apparatus of the invention, the valve means may be disposed either vertically above the top deck of the tanker vessel or vertically below the top deck within the hull of the tanker vessel.

In another preferred embodiment of the apparatus of the invention, the plurality of cargo compartments of the tanker vessel are arranged in at least one longitudinal row between the top deck and the hull bottom of the vessel for receiving the oil and the valve means interconnects selected ones of the cargo compartments.

In still a further preferred embodiment of the apparatus of the invention, the plurality of cargo compartments of the tanker vessel are arranged in adjacent longitudinal rows including a center row and at least two longitudinal rows disposed adjacent said center row between the top deck and the hull bottom of the vessel for receiving the oil. The valve means interconnects selected ones of the cargo compartments disposed in the center row of the compartments and at least one pair of the cargo compartments disposed adjacent the selected cargo compartments in the two adjacent longitudinal rows of the compartments.

The foregoing and other objects of the invention are also achieved in a method of venting hydrocarbon gases from a tanker vessel for the transportation of oil in water, which tanker vessel includes a hull comprising a bottom and sides, a top deck, a plurality of watertight cargo compartments disposed within the hull between the top deck and the hull bottom for receiving the oil, vent means coupled to each of the cargo compartments and communicative externally of the compartments to the atmosphere, and valve means coupled to and communicative with at least two of the cargo compartments and disposed at the top of the compartments. The method of the invention comprises the steps of opening, subsequent to discharging oil from at least one of the plurality of cargo compartments, the valve means coupled to the one of the compartments so as to operatively interconnect the one of the cargo compartments with another, empty cargo compartment in the tanker vessel. The vent means of the one and the another of the compartments are then closed so as to render the compartments non-communicative to the atmosphere, and the one of the cargo compartments is filled with a liquid so as to expel hydrocarbon gases from the one of the cargo compartments and vent the gases to the another of the cargo compartments through the valve means.

In a preferred embodiment of the method of the invention, the method may further comprise the step of opening, subsequent to the step of filling, the vent means coupled to the other of the compartments so as to vent the hydrocarbon gases in the another of the cargo compartments to the atmosphere. The step of filling may comprise filling the one of the cargo compartments with the liquid when the tanker vessel is operating in coastal waters, and the step of opening the vent means may comprise opening the vent means so as to vent the hydrocarbon gases from the another of the compartments to the atmosphhere when the tanker vessel is at sea.

In another preferred embodiment of the method of the invention, the step of filling may comprise filling the one of the cargo compartments with sea water ballast so as to expel the hydrocarbon gases from the one of the cargo compartments and vent the gases to the another of the compartments through the valve means. Alternatively, the step of filling may comprise filling the one of the compartments with liquid cargo so as to expel the hydrocarbon gases from the one of the cargo compartments and vent the gases to the another of the compartments through the valve means.

These and other novel features and advantages of the improved method and apparatus of the invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
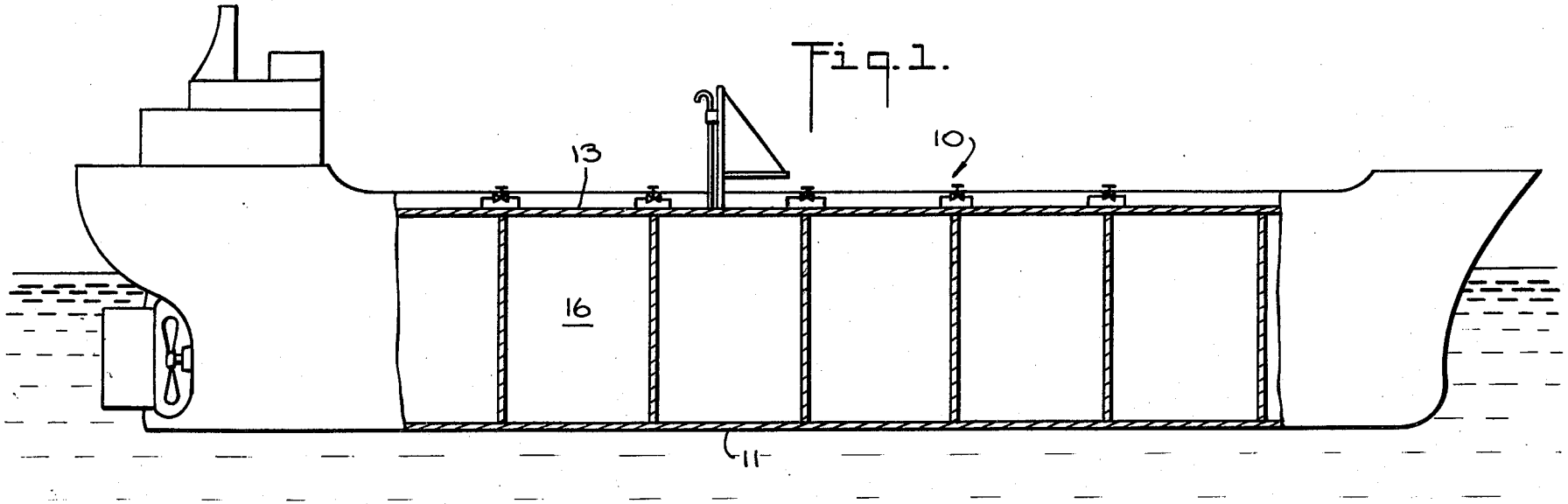
FIG. 1 is a partial, longitudinal, cross-sectional profile view of a tanker vessel including an improved apparatus for venting hydrocarbon gases from the cargo compartments of such a vessel constructed according to the present invention.
Figure 2:
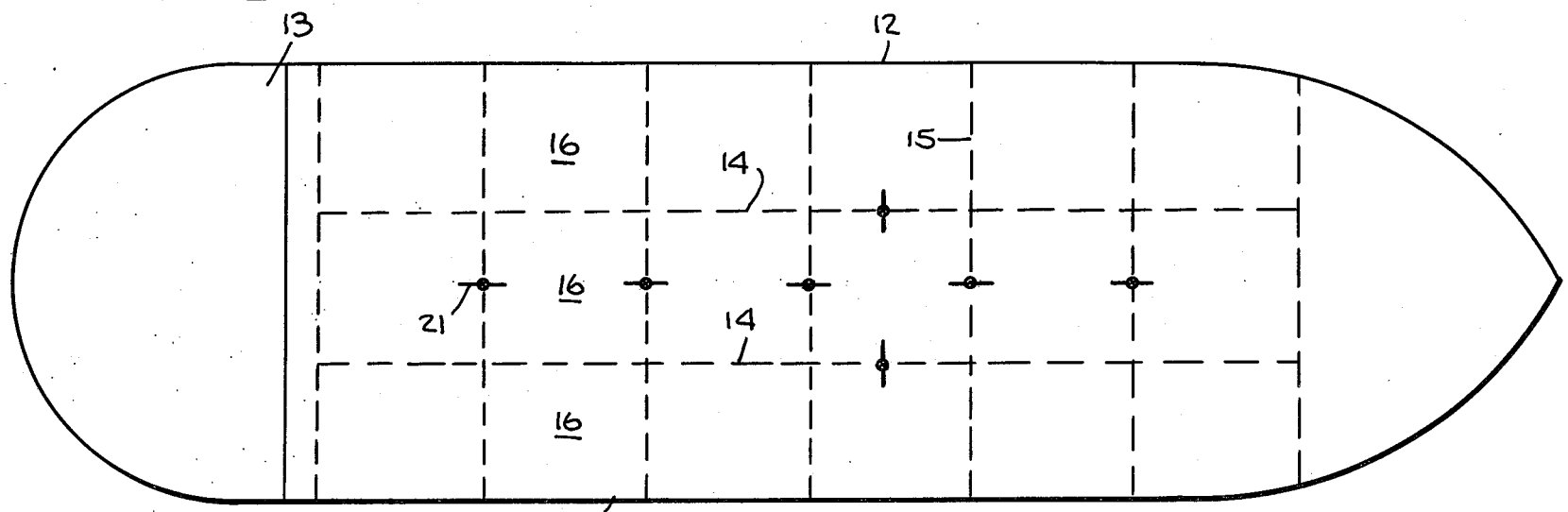
FIG. 2 is a top, plan view of the tanker vessel illustrated in FIG. 1.

Referring now to the drawings, and in particular to FIGS. 1 and 2, there is shown a tanker vessel generally identified by reference numeral 10 which includes a hull comprising a bottom 11 and sides 12. The vessel also includes a top deck 13 and a plurality of longitudinal and transverse bulkheads 14 and 15, respectively, which are disposed within the hull of the vessel and form a plurality of watertight cargo compartments 16 within the hull between the top deck and the hull bottom for receiving a liquid cargo such as oil. Vent means, illustrated in the drawings as vent closure valves 17, are coupled to each of the cargo compartments 16 by means of a pipe 18 which is part of the tanker vessel's existing pressure/vacuum relief valved vent system (not shown) and a cargo expansion trunk 19 which opens downwardly into the cargo compartment to which it is coupled. In the existing pressure/vacuum relief valved vent system of the vessel, pipes 18 are coupled to a vent manifold comprising a plurality of, typically three, pressure/vacuum relief valves by vent branch lines individually coupled to the relief valves of the manifold and to the closure valves of the cargo compartments. The relief valves are coupled to a vent trunk line in the tanker vessel which opens to the atmosphere above the top deck of the vessel. Valves 17 are of the positive-closing type and are communicative externally of the compartments through the pipes 18 for venting hydrocarbon gases, as well as air drawn into the compartments through the pressure/vacuum relief valves, to the atmosphere from cargo compartments which are empty after discharge of oil from the tanker vessel.

Figure 3:
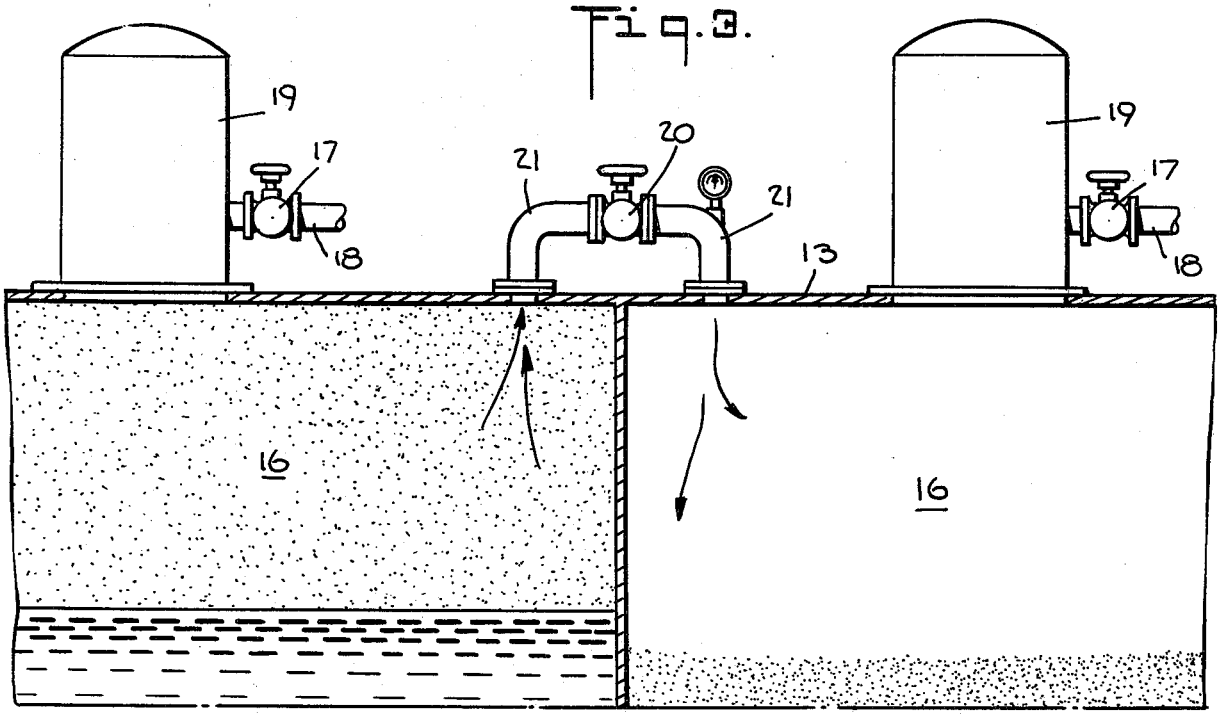
FIG. 3 is a partial, longitudinal, enlarged cross-sectional view of the cargo compartments of the tanker vessel of FIG. 1 showing the venting of hydrocarbon gases from one of the cargo compartments to another of the cargo compartments of the vessel.
Figure 4:
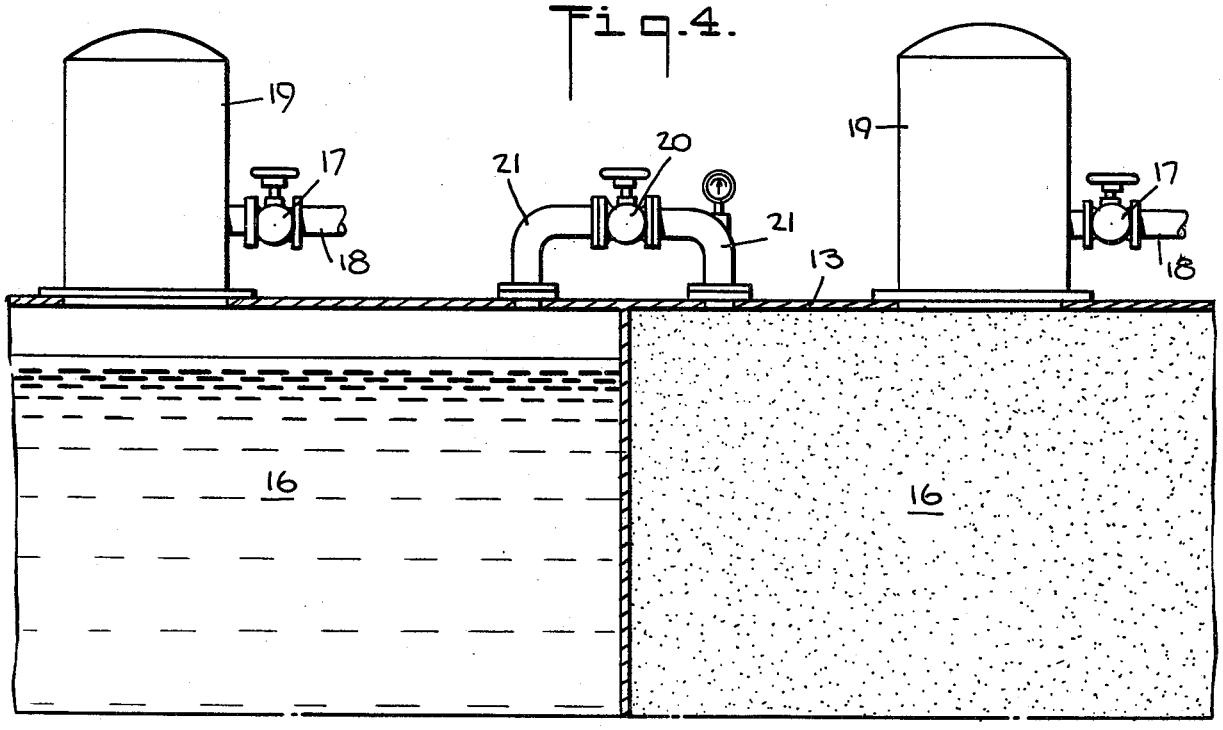
FIG. 4 is another partial, longitudinal, enlarged cross-sectional view of the cargo compartments of the tanker vessel of FIG. 1 showing the venting of the hydrocarbon gases from the another of the cargo compartments to the atmosphere using the existing vent means of the tanker vessel.

Valve means, illustrated as valves 20 and pipes 21, are coupled to and communicative with a plurality of pairs of adjacent cargo compartments. These valves and pipes interconnect pairs or more of adjacent cargo compartments and vent hydrocarbon gases from one of the interconnected compartments to the other of the two or more compartments while ballasting or reloading after discharge of oil from the one of the compartments. The valve means may, as shown in FIGS. 3 and 4, be disposed vertically above the top deck 13 of the tanker vessel. It should be noted, however, that the valve means may also be disposed vertically below the top deck within the hull of the tanker vessel for interconnecting the cargo compartments. In such an alternative embodiment, the valve could be located just below the top deck of the vessel and would include a deck stand. It also should be noted that the valve means is not limited to the specific construction illustrated in the drawings but may also comprise a crossover with a valve interconnecting the vent branch lines of the cargo compartments which operates in conjunction with an existing vent line manifold provided with positive-closing pressure relief valves.

As shown in FIG. 2, the vessel may include a plurality of transverse and longitudinal bulkheads which form a plurality of adjacent longitudinal rows of cargo compartments between the top deck and the hull bottom of the vessel for receiving oil. The valve means preferably interconnect selected ones of the cargo compartments disposed in the center row of the compartments and at least one pair of cargo compartments disposed adjacent these selected compartments in the longitudinal side rows of the compartments disposed adjacent the center row, i.e., one set of the so-called "wing tanks" of the tanker vessel. It should be noted, however, that all of the compartments of the center row of cargo compartments and one set of the "wing tank" compartments (see FIG. 2), as well as all of the cargo compartments in the tanker vessel, may be interconnected by the valve means.

In carrying out the method of the invention, oil is first discharged through the cargo discharging system of the tanker vessel from at least one of the cargo compartments 16. The valve 20 for that particular compartment is then opened so as to operatively interconnect that particular compartment with another, empty cargo compartment in the tanker vessel. The vent valve 17 of both of these compartments are then closed so as to render these compartments non-communicative to the atmosphere and, thus, prevent venting of the hydrocarbon gases contained in the compartments to the atmosphere. The first of the cargo compartments is then filled with a liquid, which may, for example, be ballast such as sea water or cargo transferred from another compartment in the vessel, or cargo reloaded from another source, whereupon the liquid entering the first of the cargo compartments expels the hydrocarbon gases in that compartment through the pipes 21 and valve 20 into the second cargo compartment where the hydrocarbon gases are contained (see FIG. 3). The filling of the first of the compartments with liquid is carried out while the tanker vessel is operating in coastal waters, i.e., in transit, berthed or anchored in port. The hydrocarbon gas contained in the second of the cargo compartments is vented from that compartment to the atmosphere by opening valve 17 coupled to the compartment when the tanker vessel is at sea (see FIG. 4). Alternatively, the hydrocarbon gases contained in the second of the compartments may remain in the compartment until the filled cargo compartment is emptied or the liquid therein is transferred to another compartment in the vessel, whereupon the gases contained in the second of the compartments will at least partially return to the first.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a tanker vessel for the transportation of oil in water, said vessel including a hull comprising a bottom and sides, a top deck, a plurality of watertight cargo compartments disposed within the hull between said top deck and said hull bottom for receiving said oil, and vent means including cargo expansion trunk means coupled to and opening downwardly into each of said cargo compartments and vent closure valve means coupled to said cargo expansion trunk means and communicative externally of said compartments for venting hydrocarbon gases from said cargo compartments through said cargo expansion trunk means to the atmosphere, the improvement comprising valve means including pipe means coupled to and communicative with at least two of said cargo compartments and opening into said compartments at the top of said compartments, said pipe means comprising first pipe means coupled to one of said cargo compartments and second pipe means coupled to the other of said cargo compartments, said valve means directly interconnecting said first and second pipe means for venting hydrocarbon gases from one of said two cargo compartments to the other of said cargo compartments through said first and second pipe means after discharge of oil from said one of said compartments.

2. The improvement recited in claim 1, wherein said first and second pipe means are curved and are coupled to said cargo compartments, extending vertically upwardly from the top of said cargo compartments, said valve means interconnecting said first and second curved pipe means for venting said hydrocarbon gases from said one of said cargo compartments to said other of said compartments through said first and second curved pipe means.

3. The improvement recited in claim 1, wherein said valve means and said first and second pipe means are disposed vertically above said top deck of said tanker vessel.

4. The improvement recited in claim 1, wherein said plurality of cargo compartments are arranged in at least one longitudinal row between said top deck and said hull bottom of said vessel for receiving said oil, said valve means and said first and second pipe means interconnecting selected ones of said cargo compartments.

5. The improvement recited in claim 1, wherein said plurality of cargo compartments are arranged in adjacent longitudinal rows including a center row and at least two longitudinal rows disposed adjacent said center row between said top deck and said hull bottom of said vessel for receiving said oil, said valve means and said first and second pipe means interconnecting selected ones of said cargo compartments disposed in said center row of said compartments and at least one pair of said cargo compartments disposed adjacent said selected cargo compartments in said two adjacent longitudinal rows of said compartments.

6. A method of venting hydrocarbon gases from a tanker vessel for the transportation of oil in water, said tanker vessel including a hull comprising a bottom and sides, a top deck, a plurality of watertight cargo compartments disposed within said hull between said top deck and said hull bottom for receiving said oil, vent means including cargo expansion trunk means coupled to and opening downwardly into each of said cargo compartments and vent closure valve means coupled to said cargo expansion trunk means and communicative externally of said compartments to the atmosphere, and valve means including pipe means coupled to and communicative with at least two of said cargo compartments and opening into said compartments at the top of said compartments, said pipe means including first pipe means coupled to one of said cargo compartments and second pipe means coupled to the other of said cargo compartments, said valve means interconnecting said first and second pipe means, said method comprising the steps of:

opening, subsequent to discharging oil from at least one of said plurality of cargo compartments, said valve means coupled to said one of said compartments so as to operatively interconnect said one of said cargo compartments with another, empty cargo compartment in said tanker vessel by means of said valve means and said first and second pipe means, closing said vent closure valve means of said vent means of said one and said another of said cargo compartments so as to render said one and said another of said compartments non-communicative to the atmosphere, and filling said one of said cargo compartments with a liquid so as to expel hydrocarbon gases from said one of said cargo compartments and vent said gases to said another of said cargo compartments through said valve means and said first and second pipe means.

7. The method recited in claim 6, further comprising the step of opening, subsequent to said step of filling, said vent closure valve means of said vent means coupled to said another of said cargo compartments so as to vent said hydrocarbon gases in said another of said compartments to the atmosphere through said cargo expansion trunk means and said vent closure valve means.

8. The method recited in claim 7, wherein said step of filling comprises filling said one of said cargo compartments with said liquid when said tanker vessel is operating in coastal waters, and wherein said step of opening said vent closure valve means comprises opening said vent closure valve means so as to vent said hydrocarbon gases from said another of said compartments to the atmosphere through said cargo expansion trunk means and said vent closure valve means when said tanker vessel is at sea.

9. The method recited in claim 6, wherein said step of filling comprises filling said one of said cargo compartments with sea water ballast so as to expel said hydrocarbon gases from said one of said cargo compartments and vent said gases to said another of said compartments through said valve means and said first and second pipe means.

10. The method recited in claim 6, wherein said step of filling comprises filling said one of said compartments with liquid cargo so as to expel said hydrocarbon gases from said one of said cargo compartments and vent said gases to said another of said compartments through said valve means and said first and second pipe means.

* * * * *